US005395746A

United States Patent [19]

Brust et al.

[11] Patent Number: 5,395,746

[45] Date of Patent: Mar. 7, 1995

[54] INHERENTLY STABLE HIGH CHLORIDE TABULAR GRAINS WITH IMPROVED BLUE ABSORPTION

[75] Inventors: Thomas B. Brust, Spencerport; Paul J. Madigan, Rochester, both of N.Y.

[73] Assignee: Eastman Kodak Company, Rochester, N.Y.

[21] Appl. No.: 202,306

[22] Filed: Feb. 25, 1994

[51] Int. Cl.[6] ..... G03C 1/035

[52] U.S. Cl. ..... 430/567; 430/569

[58] Field of Search ..... 430/567

[56] References Cited

U.S. PATENT DOCUMENTS

| | | | |
|---|---|---|---|
| 3,367,778 | 2/1968 | Berriman | 96/64 |
| 4,435,501 | 3/1984 | Maskasky | 430/434 |
| 4,463,087 | 7/1984 | Maskasky | 430/567 |
| 4,471,050 | 9/1984 | Maskasky | 430/567 |
| 4,921,784 | 5/1990 | Ikeda et al. | 430/567 |
| 5,061,617 | 10/1991 | Maskasky | 430/569 |
| 5,264,337 | 11/1993 | Maskasky | 430/567 |
| 5,275,930 | 1/1994 | Maskasky | 430/567 |
| 5,292,632 | 3/1994 | Maskasky | 430/567 |

FOREIGN PATENT DOCUMENTS

| | | |
|---|---|---|
| 0312959 | 4/1989 | European Pat. Off. . |
| 0534395 | 3/1993 | European Pat. Off. . |

*Primary Examiner*—Janet C. Baxter
*Attorney, Agent, or Firm*—Carl O. Thomas

[57] ABSTRACT

A radiation sensitive emulsion is disclosed that improves the light absorption of high chloride tabular grain emulsions in the longer wavelength half of the blue spectrum. The tabular grains each have a tabular substrate portion containing at least 50 mole percent chloride, based on silver, bounded by {100} major faces and a portion deposited on the substrate containing a silver salt exhibiting a higher solubility than silver iodide and a higher absorption of blue light at wavelengths longer than 450 nm than silver iodide.

20 Claims, 2 Drawing Sheets

INHERENTLY STABLE HIGH CHLORIDE TABULAR GRAINS WITH IMPROVED BLUE ABSORPTION

FIELD OF THE INVENTION

The invention relates to radiation sensitive silver halide emulsions.

BACKGROUND

Photographic emulsions contain grains comprised of one or a combination of silver chloride, silver bromide and silver iodide. Although these photographically useful silver halides are the sole silver salts employed for grain formation in the overwhelming majority of photographic applications, silver salts, such as silver thiocyanate, silver phosphate, silver pyrophosphate, silver cyanide, silver citrate and silver carbonate, can be incorporated in the grains in addition to the silver halide(s), as illustrated by Berriman U.S. Pat. No. 3,367,778; Maskasky U.S. Pat. Nos. 4,435,501, 4,463,087, 4,471,050 and 5,061,617 and Research Disclosure, Vol. 181, May 1979, Item 18153; Ikeda et al U.S. Pat. No. 4,921,784 and Ihama et al EPO 0 312 959. Research Disclosure is published by Kenneth Mason Publications, Ltd., Dudley House, 12 North St., Emsworth, Hampshire P010 7DQ, England.

In recent years photographic interest has focused tabular grain silver halide emulsions. An emulsion is generally and for the purposes of this invention considered to be a "tabular grain emulsion" when tabular grains account for at least 50 percent of total grain projected area. A grain is generally and for the purposes of this invention considered to be tabular when the ratio of its equivalent circular diameter (ECD) to its thickness (t) is at least 2. The equivalent circular diameter of a grain is the diameter of a circle having an area equal to the projected area of the grain. Grains in which the ratio of adjacent major face edge lengths are 10 or more are classified as rods rather than tabular grains.

Maskasky U.S. Pat. Nos. 5,264,337 and 5,275,930, House et al U.S. Pat. No. 5,320,938, and Brust et al published European Patent Application 0 534 395 disclose radiation sensitive high chloride {100} tabular grain emulsions. As employed herein the term "high chloride {100} tabular grain emulsion" indicates a high chloride tabular grain emulsion in which the tabular grains accounting for at least 50 percent of total grain projected area have major faces lying in {100} crystallographic planes. The high chloride {100} tabular grain emulsions of Maskasky, House and Brust et al represent an advance in the art in that (1) by reason of their tabular shape, they achieve the known advantages of tabular grain emulsions over nontabular grain emulsions, (2) by reason of their high chloride content they achieve the known advantages of high chloride emulsions over those of other halide compositions (e.g., rapid development and increased ecological compatibility—that is, rapid processing with more dilute developer solutions and rapid fixing with ecologically preferred sulfite ion fixers), and (3) by reason of their {100} crystal faces the tabular grains exhibit higher levels of grain shape stability, allowing the use of morphological stabilizers adsorbed to grain surfaces during emulsion preparation to be entirely eliminated. A further and surprising advantage of high chloride {100} tabular grain emulsions has been their sensitivity levels, which can be higher than previously thought possible for high chloride emulsions.

Since silver chloride exhibits lower native absorption in the blue region of the spectrum than the remaining photographic silver halides, silver bromide and silver iodide, the high chloride {100} enjoy an advantage over silver bromide and iodobromide tabular grain emulsions when employed in color photography to record minus blue (green and/or red) exposures, but a disadvantage when employed to record blue exposures. Although blue absorbing spectral sensitizing dyes can be employed, the lack of native blue sensitivity puts these emulsions at a disadvantage when used to record blue light exposures in either black-and-white or color photography.

Brust and Mis U.S. Pat. No. 5,314,798, commonly assigned incorporated into high chloride {100} tabular grains increased iodide bands. These bands improved the speed-granularity characteristics of the emulsions. The higher iodide also increased native blue sensitivity. Unfortunately, silver iodide is the least soluble of the photographic silver halides, slows development rates and is ecologically more burdensome than the other photographic halides. A further disadvantage of iodide when incorporated in high chloride {100} tabular grain emulsions is that iodide increases native blue absorption primarily in the short blue (400 to 450 nm wavelength) region of the blue spectrum rather than the long blue (450 to 500 nm) region of the spectrum that is of greater photographic interest.

SUMMARY OF THE INVENTION

An advantage of the present invention is that the advantages of high chloride {100} tabular grain emulsions are realized while also achieving improved native blue sensitivity in the longer than 450 nm portion of the blue spectrum. Further, these advantages are realized while retaining the rapid development rate and ecological compatibility features that are major benefits to be derived from selecting high chloride grain compositions.

In one aspect this invention is directed to a radiation sensitive emulsion containing a silver halide grain population, at least 50 percent of the grain population projected area being accounted for by tabular grains each having an aspect ratio of at least 2, wherein the tabular grains are each comprised of (1) a tabular substrate containing at least 50 mole percent chloride, based on silver, bounded by {100} major faces and (2) a portion deposited on the substrate containing a silver salt exhibiting a higher solubility than silver iodide and a higher absorption of blue light at wavelengths longer than 450 nm than silver iodide.

DESCRIPTION OF PREFERRED EMBODIMENTS

Figure 1:
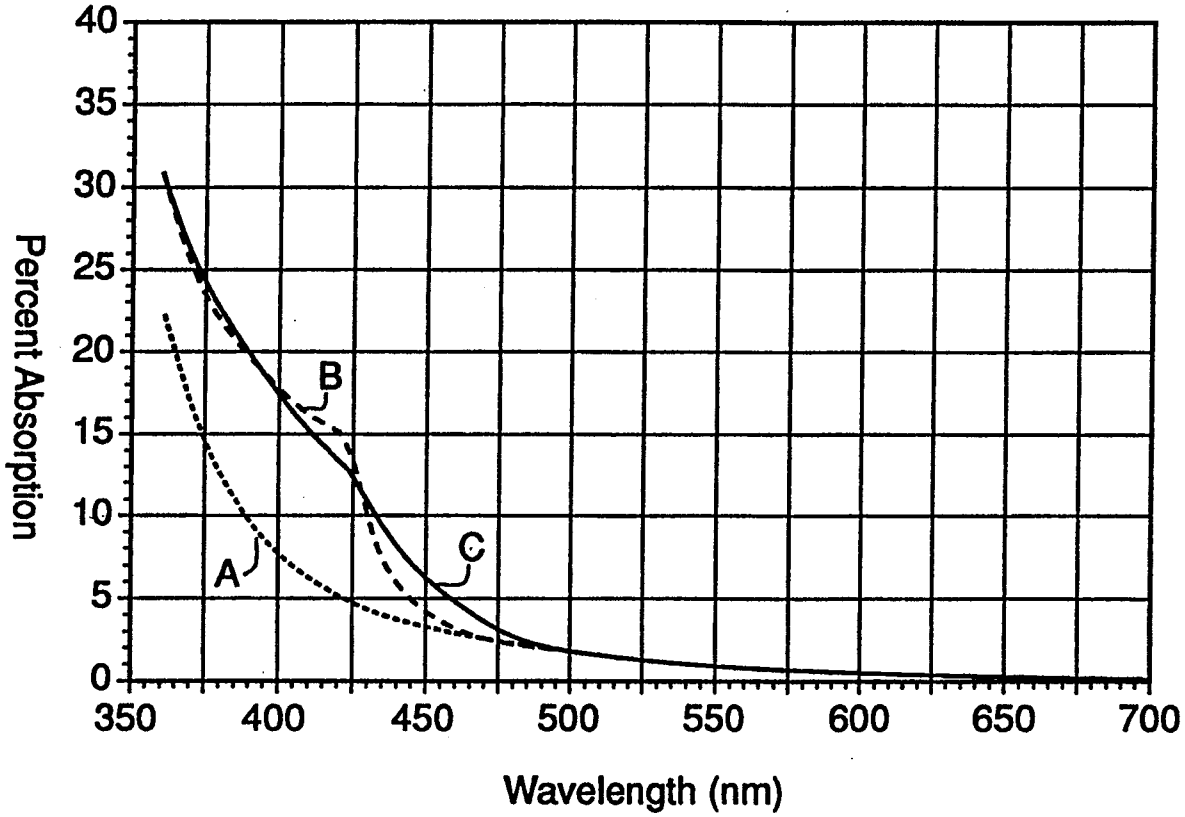
FIG. 1 is a plot of light absorption over the spectral range of from 350 to 700 nm.

The photographically useful, radiation sensitive emulsions of the invention are comprised of a dispersing medium and a grain population at least 50 percent of which is accounted for by tabular grains each having an aspect ratio of at least 2. Each of the tabular grains is comprised of a tabular substrate containing at least 50 mole percent chloride, based on silver, bounded by {100} major faces and a portion deposited on the substrate containing a silver salt exhibiting a higher solubility than silver iodide and a higher absorption of blue light at wavelengths longer than 450 nanometers (nm) than silver iodide.

The preparation of the tabular grain emulsions of the invention can commence with the preparation of a high chloride {100} tabular grain emulsion of the type disclosed by Maskasky and House et al, cited above and here incorporated by reference. The tabular grains of the starting emulsion serve as deposition hosts or substrates for silver salt used to increase blue absorption and thus these host tabular grains become tabular substrates in the completed tabular grains. The function of the substrate is to provide the tabular configuration of the completed grains and to provide a significant portion of the chloride content of the overall tabular grain structure.

One or a combination of silver salts can be deposited onto the high chloride {100} tabular grains. The host tabular grains form a substrate portion of the resulting composite grains while the silver salts are contained in a portion deposited on the substrate, hereinafter referred to as a "deposited portion". By selecting one or a combination of silver salts for inclusion in the deposited portion that exhibit a higher solubility than silver iodide and a higher absorption of blue light at wavelengths longer than 450 nm than silver iodide long blue light absorption is enhanced and reduction in emulsion photographic processing rates typical of silver iodide inclusions are avoided. Each silver salt satisfying the selection criteria above is hereinafter referred to as "the selected silver salt". By choosing rather common and environmentally compatible anions to form the selected silver salts the resulting composite tabular grain structure can approach or even exceed the environmental compatibility of the host tabular grains. Silver phosphate represents a particularly preferred selected silver salt capable of providing all of the advantages noted above.

The selected silver salt can be deposited alone on the {100} crystal faces of the host tabular grains when its crystal lattice configuration is compatible with the rock salt face centered cubic crystal lattice of the high chloride host grains. It is preferred to coprecipitate the selected silver salt with silver chloride and, optionally, small amounts of silver bromide and/or iodide, in forming the deposited portion of the tabular grains. This facilitates epitaxial deposition of the surrounding portion onto the high chloride host grains, even when the selected silver salt exhibits a markedly different crystal lattice structure than the host grains.

Any amount of the silver salt can be introduced into the deposited portion that is effective to increase long blue absorption. For any given selection of the silver salt the long blue absorption can be increased in either or both of two different ways: (1) by increasing the proportion of the silver salt in the deposited portion or (2) by increasing the proportion of total grain silver present in the deposited portion as compared to the substrate.

It is generally preferred that the selected silver salt constitute from 1 to 50 mole percent of the deposited portion of the grain structure with other silver salts constituting the balance. Silver iodide, if coprecipitated with the silver salt, is preferably limited to up to 10 mole percent and preferably less than 3 mole percent, based on silver forming the deposited portion. The purpose for limiting the iodide concentration is to minimize its known disadvantages, previously discussed. Silver bromide, like silver chloride, forms a face centered cubic rock salt cubic crystal lattice structure and exhibits crystal lattice compatibility with silver chloride in all proportions. Nevertheless, in the absence of any clear advantage for its incorporation silver bromide is also preferably limited to concentrations of up to 10 mole percent and preferably less than 3 mol percent, based on the silver forming the deposited portion. Other silver salts known to be included in silver halide grains, but failing to satisfy the criteria set out above for the selected silver salt, can also be incorporated in the deposited portion, but are preferably also limited to concentrations of less than 5 mole percent, based on silver in the deposited portion. The balance of the deposited portion is formed of silver chloride. Silver chloride preferably accounts for at least 50 mole percent of the total silver forming the deposited portion.

When the selected silver salt is silver phosphate, it is generally present in the deposited portion in a concentration ranging from 1 to 50 mole percent, based on the silver forming the deposited portion. A preferred minimum concentration of phosphate is 5 mole percent, and a preferred maximum concentration is 30 mole percent, optimally 20 mole percent, based on silver in the deposited portion. The presence of iodide facilitates phosphate ion inclusion in the crystal lattice structure of the deposited portion. Phosphate inclusion is enhanced by the inclusion of 0.1 mole percent iodide, with at least 0.5 mole percent iodide being a preferred inclusion and at least 1 mole percent iodide being most preferred, each percent being referenced to total silver in the deposited portion. Preferably the deposited portion consists essentially of silver phosphate and silver iodide in the proportions indicated, with silver chloride constituting the balance of the deposited portion. It is, of course, recognized that one or more of silver bromide and the other silver salts known to form photographic silver salt grain structures can be present in the deposited portion in concentrations compatible with the iodide, phosphate and chloride concentrations previously mentioned.

The proportions of the total silver present in the substrate and the deposited portion can be varied within any convenient range compatible with retaining a tabular grain configuration and a significant increase in long blue absorption. Typically the substrate accounts for from 5 to 95 percent of total silver forming the final grain structure. By starting with very thin host tabular grains most of the total silver can be located in the deposited portion. This offers the advantage of allowing the concentrations of the selected silver salt in the deposited portion to be held to low levels while still accounting for a fully satisfactory proportion of the grain, based on total silver. For convenience it is preferred that the substrate portions of the grains account for at least 50 percent of total silver. This allows thicker tabular grains to be employed as host grains. In those instances were the selected silver salt is deposited alone or in combination with a low proportion of silver halide(s) or other salts, a significant enhancement in long blue absorption may be realized with a very low fraction of total silver in the deposited portion.

In the simplest construction of the invention the selected silver salt is distributed throughout the deposited portion of each tabular grain—e.g., uniformly distributed within the deposited portion. It is alternatively recognized that the selected silver salt can be concentrated in a particular region of the deposited portion. It is known, for example, that iodide banding, described by Brust and Mis, cited above, and discussed in more detail below, can improve the speed-granularity characteristics of high chloride {100} tabular grains. It has further been observed that coprecipitating silver phosphate and silver iodide improves the inclusion of the former. Thus, it is specifically contemplated to prepare grains containing banded inclusions of the selected silver salt. The banded inclusions of the selected silver salt can be undertaken in the absence of iodide banding, but are particularly contemplated to be undertaken with iodide banding. Concurrently formed silver iodide and silver phosphate banding is a specific, preferred embodiment of the invention.

The thickness of each composite tabular grain cannot be less than the thickness of its included substrate tabular grain. Maskasky and House et al, cited and incorporated by reference above, disclose high chloride {100} tabular grain emulsions with tabular grains ranging in thickness from 0.01 μm to less than 0.3 μm. If the deposited portion of the grains is formed exclusively along the edges of the host tabular grains, no thickening of the composite grains may be realized. However, to increase blue light absorption it is preferred to deposit the selected silver salt over the major faces of the host tabular grains. It is therefore contemplated that the minimum average thickness of the composite tabular grains will be only rarely less than 0.1 μm and, more typically, will be in the range of from 0.1 to 0.5 μm.

Since the tabular grains accounting for at least 50 percent of total grain projected area must exhibit an aspect ratio (ECD/t) of at least 2, the average aspect ratio of the high chloride {100} tabular host grain population can only approach 2 as a lower limit. In fact, the tabular grain emulsions of the invention typically exhibit average aspect ratios of 3 or more, with an average aspect ratio of at least 5 being preferred and high average aspect ratios (>8) generally being most preferred. Since the host tabular grains can have extremely high average aspect ratios ranging up to 100 or even 200, it is recognized that the composite tabular grains can also have relatively high average aspect ratios. However, to enhance long blue absorption it is generally preferred that the composite tabular grains have average aspect ratios that do not exceed 100 and optimally do not exceed 50. Nevertheless, it should be pointed out that, since the eye is least sensitive to granularity in the blue portion of the spectrum, it is possible to provide relatively thick tabular grains while retaining high average aspect ratios merely by increasing the average ECD of the emulsion grains. It is generally recognized that the photographically useful limit of average grain ECD's is 10 μm, but in practice average ECD's rarely exceed 6 μm.

So long as the population of tabular grains satisfying the parameters noted above accounts for at least 50 percent of total grain projected area a photographically desirable grain population is available. It is recognized that the advantageous properties of the emulsions of the invention are increased as the proportion of tabular grains having {100} major faces is increased. The preferred emulsions according to the invention are those in which at least 70 percent and optimally at least 90 percent of total grain projected area is accounted for by tabular grains having {100} major faces.

So long as tabular grains having the desired characteristics described above account for the requisite proportion of the total grain projected area, the remainder of the total grain projected area can be accounted for by any combination of coprecipitated grains. It is, of course, common practice in the art to blend emulsions to achieve specific photographic objectives. Blended emulsions in which at least one component emulsion satisfies the tabular grain descriptions above are specifically contemplated.

Apart from the features specifically noted above the tabular grain emulsions of the invention employ any one or combination of conventional photographic features. For example, the grains can include photographically useful dopants, either in the substrate tabular grains or in the deposited portion. Such dopants can be incorporated in concentrations of up to $10^{-2}$ mole per silver mole and are typically incorporated in concentrations of up to $10^{-4}$ mole per silver mole. Compounds of metals such as copper, thallium, lead, mercury, bismuth, zinc, cadmium, rhenium, and Group VIII metals (e.g., iron, ruthenium, rhodium, palladium, osmium, iridium, and platinum) can be present during grain precipitation. The modification of photographic properties is related to the level and location of the dopant within the grains. When the metal forms a part of a coordination complex, such as a hexacoordination complex or a tetracoordination complex, the ligands can also be included within the grains and the ligands can further influence photographic properties. Coordination ligands, such as halo, aquo, cyano cyanate, thiocyanate, nitrosyl, thionitrosyl, oxo and carbonyl ligands are contemplated and can be relied upon to modify photographic properties.

Dopants and their addition are illustrated by Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,950,972; McBride U.S. Pat. No. 3,287,136; Sidebotham U.S. Pat. No. 3,488,709; Rosecrants et al U.S. Pat. No. 3,737.,313; Spence et al U.S. Pat. No. 3,687,676; Gilman et al U.S. Pat. No. 3,761,267; Shiba et al U.S. Pat. No. 3,790,390; Ohkubo et al U.S. Pat. No. 3,890,154; Iwaosa et al U.S. Pat. No. 3,901,711; Habu et al U.S. Pat. No. 4,173,483; Atwell U.S. Pat. No. 4,269,927; Janusonis et al U.S. Pat. No. 4,835,093; McDugle et al U.S. Pat. Nos. 4,933,272, 4,981,781, and 5,037,732; Keevert et al U.S. Pat. No. 4,945,035; and Evans et al U.S. Pat. No. 5,024,931, the disclosures of which are here incorporated by reference. For background as to alternatives known to the art attention is directed to B. H. Carroll, "Iridium Sensitization: A Literature Review", Photographic Science and Engineering, Vol. 24, NO. 6, Nov./Dec. 1980, pp. 265–257, and Grzeskowiak et al published European Patent Application 0 264 288.

The emulsions of the invention can be chemically sensitized with active gelatin as illustrated by T. H. James, The Theory of the Photographic Process, 4th Ed., Macmillan, 1977, pp. 67–76, or with sulfur, selenium, tellurium, gold, platinum, palladium, iridium, osmium, rhenium or phosphorus sensitizers or combinations of these sensitizers, such as at pAg levels of from 5 to 10, pH levels of from 5 to 8 and temperatures of from 30° to 80° C., as illustrated by Research Disclosure, Vol. 120, April, 1974, Item 12008, Research. Disclosure, Vol. 134, June, 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent 1,396,696; chemical sensitization being optionally conducted in the presence of thiocyanate derivatives as described in Damschroder U.S. Pat. No. 2,642,361; thioether compounds as disclosed in Lowe et al U.S. Pat. No. 2,521,926, Williams et al U.S. Pat. No. 3,021,215 and Bigelow U.S. Pat. No. 4,054,457; and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714; elemental sulfur as described by Miyoshi et al European Patent Application EP 294,149 and Tanaka et al European Patent Application EP 297,804; and thiosulfonates as described by Nishikawa et al European Patent Application EP 293,917. Additionally or alternatively, the emulsions can be reduction-sensitized—e.g., with hydrogen, as illustrated by Janusonis U.S. Pat. No. 3,891,446 and Babcock et al U.S. Pat. No. 3,984,249, by low pAg (e.g., less than 5), high pH (e.g., greater than 8) treatment, or through the use of reducing agents such as stannous chloride, thiourea dioxide, polyamines and amineboranes as illustrated by Allen et al U.S. Pat. No. 2,983,609, Oftedahl et al Research Disclosure, Vol. 136, August, 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,435,501, Ihama et al U.S. Pat. No. 4,693,965 and Ogawa U.S. Pat. No. 4,791,053. Chemical sensitization can be directed to specific sites or crystallographic faces on the silver halide grain as described by Haugh et al U.K. Patent Application 2,038,792A and Mifune et al published European Patent Application EP 302,528. Chemical sensitization can performed on the host tabular grains prior to formation of the deposited portion of the grains. In this instance the sensitivity centers resulting from chemical sensitization can be partially or totally occluded by the deposited portions of the tabular grains. Alternatively, chemical sensitization can occur concurrently with precipitation of the deposited portions of the tabular grains using such means as twin-jet additions or pAg cycling with alternate additions of silver and halide or the anions of the selected salts as generally described by Morgan U.S. Pat. No. 3,917,485, Becker U.S. Pat. No. 3,966,476 and Research Disclosure, Vol. 181, May, 1979, Item 18155.

Although the inclusion of the selected salt within the deposited portions of the tabular grains increases long blue absorption and hence blue speed in this spectral region, further enhancements of absorption within any desired portion of the blue spectrum (i.e., in any or all of the spectral region from 400 to 500 nm), can be realized by employing one or a combination of spectral sensitizing dyes that absorb blue light, hereinafter referred to as "blue spectral sensitizers". The use of blue spectral sensitizers in the emulsions of the invention is analogous to the use of blue spectral sensitizers in silver iodobromide emulsions, where the iodobromide composition assures native blue sensitivity, but overall blue sensitivity is significantly further enhanced by adsorbing blue spectral sensitizing dye to the silver iodobromide grain surfaces.

The emulsions of the invention can be spectrally sensitized with blue absorbing dyes from a variety of classes, including the polymethine dye class, which includes the cyanines, merocyanines, styryls, merostyryls, streptocyanines, hemicyanines, arylidenes, and enamine cyanines.

Preferred blue spectral sensitizers are the cyanine spectral sensitizing dyes that include, joined by a monomethine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

Also preferred as blue sensitizers are so-called "zero methine" merocyanine spectral sensitizing dyes. These dyes include a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione. The methine groups linking the basic and acidic nuclei are part of the nuclei—i.e., there is no methine group positioned between the basic and acidic nuclei.

One or more blue spectral sensitizing dyes may be employed. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, Photographic Science and Engineering, Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

The blue spectral sensitizers (including combinations) disclosed by House et al, cited and incorporated by reference above, are preferred. An extensive listing of useful blue sensitizers are also provided by Kofron et al U.S. Pat. No. 4,439,520, the disclosure of which is here incorporated by reference.

Spectral sensitizing dyes can be added at any stage during the emulsion preparation. They may be added at the beginning of or during precipitation as described by Wall, Photographic Emulsions, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and Research Disclosure, Vol. 181, May, 1979, Item 18155, and Tani et al published European Patent Application EP 301,508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71. The dyes can be selectively adsorbed to particular crystallographic faces of the emulsion grain as a means of restricting chemical sensitization centers to other faces, as described by Mifune et al published European Patent Application 302,528. The spectral sensitizing dyes may be used in conjunction with poorly adsorbed luminescent dyes, as described by Miyasaka et al published European Patent Applications 270,079, 270,082 and 278,510.

To avoid instability in emulsion coatings, stabilizers and antifoggants can be employed, such as halide ions (e.g., bromide salts); chloropalladates and chloropalladites, as illustrated by Trivelli et al U.S. Pat. No. 2,566,263; water-soluble inorganic salts of magnesium, calcium, cadmium, cobalt, manganese and zinc, as illustrated by Jones U.S. Pat. No. 2,839,405 and Sidebotham U.S. Pat. No. 3,488,709; mercury salts, as illustrated by Allen et al U.S. Pat. No. 2,728,663; selenols and diselenides, as illustrated by Brown et al U.K. Patent 1,336,570 and Pollet et al U.K. Patent 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes, as illustrated by Thiers et al U.S. Pat. No. 3,630,744; isothiourea derivatives, as illustrated by Herz et al U.S. Pat. No. 3,220,839 and Knott et al U.S. Pat. No. 2,514,650; thiazolidines, as illustrated by Scavron U.S. Pat. No. 3,565,625; peptide derivatives, as illustrated by Maffet U.S. Pat. No. 3,274,002; pyrimidines and 3-pyrazolidones, as illustrated by Welsh U.S. Pat. No. 3,161,515 and Hood et al U.S. Pat. No. 2,751,297; azotriazoles and azotetrazoles, as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, Research Disclosure, Vol. 134, June, 1975, Item 13452, and Vol. 148, August, 1976, Item 14851, and Nepker et al U.K. Patent 1,338,567; mercapto-tetrazoles, -triazoles and -diazoles, as illustrated by Kendall et al U.S. Pat. No. 2,403,927, Kennard et al U.S. Pat. No. 3,266,897, Research Disclosure, Vol. 116, December, 1973, Item 11684, Luckey et al U.S. Pat. No. 3,397,987 and Salesin U.S. Pat. No. 3,708,303; azoles, as illustrated by Peterson et al U.S. Pat. No. 2,271,229 and Research Disclosure, Item 11684, cited above; purines, as illustrated by Sheppard et al U.S. Pat. No. 2,319,090, Birr et al U.S. Pat. No. 2,152,460, Research Disclosure, Item 13452, cited above, and Dostes et al French Patent 2,296,204, polymers of 1,3-dihydroxy(and/or 1,3-carbamoxy)-2-methylenepropane, as illustrated by Saleck et al U.S. Pat. No. 3,926,635 and tellurazoles, tellurazolines, tellurazolinium salts and tellurazolium salts, as illustrated by Gunther et al U.S. Pat. No. 4,661,438, aromatic oxatellurazinium salts as illustrated by Gunther, U.S. Pat. No. 4,581,330 and Przyklek-Elling et al U.S. Pat. Nos. 4,661,438 and 4,677,202. High chloride emulsions can be stabilized by the presence, especially during chemical sensitization, of elemental sulfur, as described by Miyoshi et al European published Patent Application EP 294,149 and Tanaka et al European published Patent Application EP 297,804 and thiosulfonates, as described by Nishikawa et al European published Patent Application EP 293,917.

Among useful stabilizers for gold sensitized emulsions are water-insoluble gold compounds of benzothiazole, benzoxazole, naphthothiazole and certain merocyanine and cyanine dyes, as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Patent 1,466,024 and Habu et al U.S. Pat. No. 3,929,486; quaternary ammonium salts of the type illustrated by Piper U.S. Pat. No. 2,886,437; water-insoluble hydroxides, as illustrated by Maffet U.S. Pat. No. 2,953,455; phenols, as illustrated by Smith U.S. Pat. Nos. 2,955,037 and '038; ethylene diurea, as illustrated by Dersch U.S. Pat. No. 3,582,346; barbituric acid derivatives, as illustrated by Wood U.S. Pat. No. 3,617,290; boranes, as illustrated by Bigelow U.S. Pat. No. 3,725,078; 3-pyrazolidinones as illustrated by Wood U.K. Patent 1,158,059 and aldoximines, amides, anilides and esters as illustrated by Butler et al U.K. Patent 988,052.

The emulsions can be protected from fog and desensitization caused by trace amounts of metals such as copper, lead, tin, iron and the like by incorporating addenda such as sulfocatechol-type compounds, as illustrated by Kennard et al U.S. Pat. No. 3,236,652; aldoximines, as illustrated by Carroll et al U.K. Patent 623,448 and meta- and polyphosphates as illustrated by Draisbach U.S. Pat. No. 2,239,284, and carboxylic acids such as ethylenediamine tetraacetic acid, as illustrated by U.K. Patent 691,715.

Among stabilizers useful in layers containing synthetic polymers of the type employed as vehicles and to improve covering power are monohydric and polyhydric phenols, as illustrated by Forsgard U.S. Pat. No. 3,043,697; saccharides, as illustrated by U.K. Patent 897,497 and Stevens et al U.K. Patent 1,039,471, and quinoline derivatives, as illustrated by Dersch et al U.S. Pat. No. 3,446,618.

Among stabilizers useful in protecting the emulsion layers against dichroic fog are addenda such as salts of nitron, as illustrated by Barbier et al U.S. Pat. Nos. 3,679,424 and 3,820,998; mercaptocarboxylic acids, as illustrated by Willems et al U.S. Pat. No. 3,600,178; and addenda listed by E. J. Birr, Stabilization of Photographic Silver Halide Emulsions, Focal Press, London, 1974, pp. 126–218.

Among stabilizers useful in protecting emulsion layers against development fog are addenda such as azabenzimidazoles, as illustrated by Bloom et al U.K. Patent 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles, and the like, as illustrated by Brooker et al U.S. Pat. No. 2,131,038, Land U.S. Pat. No. 2,704,721, Rogers et al U.S. Pat. No. 3,265,498; mercapto-substituted compounds, e.g., mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No. 3,706,557; isothiourea derivatives, as illustrated by Herz et al U.S. Pat. No. 3,220,839, and thiodiazole derivatives, as illustrated by von Konig U.S. Pat. No. 3,364,028 and von Konig et al U.K. Patent 1,186,441.

Where hardeners of the aldehyde type are employed, the emulsion layers can be protected with antifoggants such as monohydric and polyhydric phenols of the type illustrated by Sheppard et al U.S. Pat. No. 2,165,421; nitro-substituted compounds of the type disclosed by Rees et al U.K. Patent 1,269,268; poly(alkylene oxides), as illustrated by Valbusa U.K. Patent 1,151,914, and mucohalogenic acids in combination with urazoles, as illustrated by Allen et al U.S. Pat. Nos. 3,232,761 and 3,232,764, or further in combination with maleic acid hydrazide, as illustrated by Rees et al U.S. Pat. No. 3,295,980.

To protect emulsion layers coated on linear polyester supports, addenda can be employed such as parabanic acid, hydantoin acid hydrazides and urazoles, as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of thallous nitrate, as illustrated by Overman U.S. Pat. No. 2,628,167; compounds, polymeric lattices and dispersions of the type disclosed by Jones et al U.S. Pat. Nos. 2,759,821 and '822; azole and mercaptotetrazole hydrophilic colloid dispersions of the type disclosed by Research Disclosure, Vol. 116, December, 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric lattices prepared by emulsion polymerization in the presence of poly(alkylene oxide) as disclosed by Pearson et al U.S. Pat. No. 3,772,032, and gelatin graft copolymers of the type disclosed by Rakoczy U.S. Pat. No. 3,837,861.

Where the photographic element is to be processed at elevated bath or drying temperatures, as in rapid access processors, pressure desensitization and/or increased fog can be controlled by selected combinations of addenda, vehicles, hardeners and/or processing conditions as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, Research Disclosure, Vol. 99, July, 1972, Item 9930, Florens et al U.S. Pat. No. 3,843,364, Priem et al U.S. Pat. No. 3,867,152, Adachi et al U.S. Pat. No. 3,967,965 and Mikawa et al U.S. Pat. Nos. 3,947,274 and 3,954,474.

In addition to increasing the pH or decreasing the pAg of an emulsion and adding gelatin, which are known to retard latent-image fading, latent-image stabilizers can be incorporated, such as amino acids, as illustrated by Ezekiel U.K. Patents 1,335,923, 1,378,354, 1,387,654 and 1,391,672, Ezekiel et al U.K. Patent 1,394,371, Jefferson U.S. Pat. No. 3,843,372, Jefferson et al U.K. Patent 1,412,294 and Thurston U.K. Patent 1,343,904; carbonyl-bisulfite addition products in combination with hydroxybenzene or aromatic amine developing agents, as illustrated by Seiter et al U.S. Pat. No. 3,424,583; cycloalkyl-1,3-diones, as illustrated by Beckett et al U.S. Pat. No. 3,447,926; enzymes of the catalase type, as illustrated by Matejec et al U.S. Pat. No. 3,600,182; halogen-substituted hardeners in combination with certain cyanine dyes as illustrated by Kumai et al U.S. Pat. No. 3,881,933; hydrazides, as illustrated by Honig et al U.S. Pat. No. 3,386,831; alkenyl benzothiazolium salts, as illustrated by Arai et al U.S. Pat. No. 3,954,478; hydroxy-substituted benzylidene derivatives, as illustrated by Thurston U.K. Patent 1,308,777 and Ezekiel et al U.K. Patents 1,347,544 and 1,353,527; mercapto-substituted compounds of the type disclosed by Sutherns U.S. Pat. No. 3,519,427; metal-organic complexes of the type disclosed by Matejec et al U.S. Pat. No. 3,639,128; penicillin derivatives, as illustrated by Ezekiel U.K. Patent 1,389,089; propynylthio derivatives of benzimidazoles, pyrimidines, etc., as illustrated by yon Konig et al U.S. Pat. No. 3,910,791; combinations of iridium and rhodium compounds as disclosed by Yamasue et al U.S. Pat. No. 3,901,713; sydnones or sydnone imines, as illustrated by Noda et al U.S. Pat. No. 3,881,939; thiazolidine derivatives, as illustrated by Ezekiel U.K. Patent 1,458,197 and thioether-substituted imidazoles, as illustrated by Research Disclosure, Vol. 136, August, 1975, Item 13651.

Apart from the features that have been specifically discussed the tabular grain emulsion preparation procedures, the tabular grains that they produce, and their further use in photography can take any convenient conventional form. Substitution for conventional emulsions of the same or similar silver halide composition is generally contemplated, with substitution for silver halide emulsions of differing halide composition, particularly tabular grain emulsions, being also feasible in many types of photographic applications. Conventional features are further illustrated by the following incorporated by reference disclosures:

ICBR-1 Research Disclosure, Vol. 308, December 1989, Item 308,119;

ICBR-2 Research Disclosure, Vol. 225, January 1983, Item 22,534;

ICBR-3 Wey et al U.S. Pat. No. 4,414,306, issued Nov. 8, 1983;

ICBR-4 Solberg et al U.S. Pat. No. 4,433,048, issued Feb. 21, 1984;

ICBR-5 Wilgus et al U.S. Pat. No. 4,434,226, issued Feb. 28, 1984;

ICBR-6 Maskasky U.S. Pat. No. 4,435,501, issued Mar. 6, 1984;

ICBR-7 Maskasky U.S. Pat. No. 4,643,966, issued Feb. 17, 1987;

ICBR-8 Daubendiek et al U.S. Pat. No. 4,672,027, issued Jan. 9, 1987;

ICBR-9 Daubendiek et al U.S. Pat. No. 4,693,964, issued Sep. 15, 1987;

ICBR-10 Maskasky U.S. Pat. No. 4,713,320, issued Dec. 15, 1987;

ICBR-11 Saitou et al U.S. Pat. No. 4,797,354, issued Jan. 10, 1989;

ICBR-12 Ikeda et al U.S. Pat. No. 4,806,461, issued Feb. 21, 1989;

ICBR-13 Makino et al U.S. Pat. No. 4,853,322, issued Aug. 1, 1989; and

ICBR-14 Daubendiek et al U.S. Pat. No. 4,914,014, issued Apr. 3, 1990.

The emulsions of the invention are contemplated for use as monochromatic, orthochromatic or panchromatic emulsions in black-and-white photographic elements or as blue recording emulsion layers in multicolor photographic elements. Imagewise exposures at ambient, elevated or reduced temperatures and/or pressures, including high- or low-intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, The Theory of the Photographic Process, 4th Ed., Macmillan, 1977, Chapters 4, 6, 17, 18 and 23.

Examples

The invention can be better appreciated by reference to the following examples. The term "low methionine gelatin" is employed, except as otherwise indicated, to designate gelatin that has been treated with an oxidizing agent to reduce its methionine content to less than 30 micromoles per gram.

Emulsion Precipitations

Emulsion A (a comparative emulsion)

This emulsion is a high chloride {100} tabular grain emulsion consisting essentially of 99.94 mole percent chloride and 0.06 mole percent iodide, based on silver, used only for grain nucleation.

A 45 L solution containing 0.87% by weight of low methionine gelatin, 0.0057M sodium chloride and 9.0 mL of polyethylene glycol antifoamant was provided in a stirred reaction vessel at 45° C. While the solution was vigorously stirred, 700 mL of a 0.024M potassium iodide solution were added, followed by the simultaneous addition of 217.5 mL of 4.0M silver nitrate containing 0.08 mg of mercuric chloride per mole of silver nitrate and 217.5 mL of 4.0 sodium chloride solution each at a rate of 435 mL/min. The mixture was then held for 6 minutes while a 56.3 L solution containing 0.338 g/L sodium chloride and 0.062 g/L potassium iodide was added during the first 3 minutes with the temperature remaining at 45° C. Following the hold, the 4.0M silver nitrate solution containing the mercuric chloride and the 4.0M sodium chloride solution were added simultaneously at 145 mL/min for 5 minutes, followed by a linear acceleration from 145 mL/min to 412 mL/min over 46 minutes, then constant at 145 mL/min for 8 minutes with the pCl controlled at 2.0. The pCl was then adjusted to 1.65 with sodium chloride, and the emulsion was washed and concentrated using ultrafiltration at a pCl of 2.0. Low methionine gelatin was added to a level of 35 grams per mole of silver halide, then the pCl was adjusted to 1.65 with sodium chloride, and the pH was adjusted to 5.7.

The resultant high chloride {100} tabular grain emulsion had a mean ECD of 0.96 μm and a mean grain thickness of 0.09 μm with tabular grains having {100} major faces and aspect ratios of greater than 2 accounting for greater than 70 percent of total grain projected area.

Emulsion E (a comparative emulsion)

This emulsion was precipitated by depositing additional silver halide (29% additional silver) on the grains of Emulsion A. The composition of the final emulsion was 97.8 mole percent silver chloride and 2.2 mole percent silver iodide.

Emulsion A in the amount of 1 mole of silver and distilled water to a combined volume of 2.5 liters were introduced into a well stirred reaction vessel at 40° C. A 1.0 molar silver nitrate solution and a 0.9M sodium chloride 0.1M potassium iodide solution were added simultaneously at 25 mL/min for 11.5 minutes with the pH controlled at 5.7. Forty grams of phthalated gelatin were then added, and the emulsion was washed by the procedures of Yutzy et al U.S. Pat. No. 2,614,918. Thirty-two grams of low methionine gelatin were added, the pH of the emulsion was adjusted to 5.0, and the emulsion was chill set.

The emulsion was examined by scanning electron microscopy (SEM). The grains remained high chloride {100} tabular grains with sharp corners. There was no evidence of grain renucleation or of non-uniform epitaxial depositions.

Emulsion C (an emulsion according to the invention)

This emulsion was prepared by the procedure described above for Emulsion B, except that the 0.9M sodium chloride and 0.1M potassium iodide solution was replaced by a solution of 0.3M sodium dihydrogen phosphate monohydrate and 0.1M potassium iodide. The pH was controlled at about 5.7 by additions of dilute sodium hydroxide solution.

When examined by SEM the resulting emulsion showed grains similar to those of Emulsion B, but with rounded corners. There was no evidence of grain renucleation or of non-uniform epitaxial depositions.

Emulsion D (an emulsion according to the invention)

This emulsion was formed by depositing silver iodophosphate along with silver chloride onto a high chloride {100} tabular grain emulsion host containing 67 percent of total silver. The final emulsion contained 78.5 mole percent chloride, 20 mole percent phosphate and 2.5 mole percent iodide, based on total silver.

A 4.4 L solution containing 0.80% by weight of low methionine gelatin, 0.0057M sodium chloride and 0.2 mL of polyethylene glycol antifoamant was provided in a stirred reaction vessel at 50° C. While the solution was vigorously stirred, 135 mL of a 0.01M potassium iodide solution were added followed by the simultaneous addition of 24 mL of 1.5M silver nitrate containing 0.08 mg of mercuric chloride per mole of silver nitrate and 24 mL of 1.5 sodium chloride solution each at a rate of 48 mL/min. The mixture was then held for 30 seconds. Following the hold, the 1.5M sodium nitrate solution containing the mercuric chloride and the 1.5M sodium chloride solution were added simultaneously at 12 mL/min for 30 minutes. The stoichiometric excess of chloride was then increased by adding only the 1.5M sodium chloride solution at 64 mL/min for 3.0 minutes. The crystal growth was then resumed by simultaneous addition of the 1.5M silver nitrate and sodium chloride solutions using a linear flow rate acceleration of from 12 mL/min to 72 mL/min over 90 minutes with pCl controlled at 1.4. The flow of the reactants was then stopped, and the emulsion was held for 2 minutes while 42 grams of 2.0M nitric acid were added to adjust the pH to 3.0. The 1.5M silver nitrate solution and a 1.5N salt solution consisting of 0.45M trisodium phosphate dodecahydrate and 0.15M potassium iodide were then added simultaneously at 45 mL/min for 35 minutes with the pH maintained constant. Introduction of the solution containing iodide and phosphate salts was then stopped, and the 1.5M silver nitrate solution addition was continued at 36 mL/min for 12.5 minutes. The silver nitrate flow was stopped, and 600 mL of 1.5M sodium chloride were then added over 6 minutes. The emulsion was concentrated to approximately 8 L by ultrafiltration and then diluted back to 18 L with distilled water. The concentration and dilution steps were repeated followed by the addition of 220 mL of a 4.0M sodium chloride solution. One hundred fifty grams of low methionine gelatin were added along with 750 mL of distilled water and 55 mL of a 34 g/L 4-chloro-3,5-xylenol antibacterial solution. The final pH was adjusted to 5.67, and 15.5 mL of 4.0M sodium chloride were added to adjust pCl.

When examined by SEM the resulting emulsion showed grains having the shape of high chloride {100} tabular grains, indicating host grains of this tabular form had been formed before iodide and phosphate salt introductions occurred. The tabular grains of the completed emulsion exhibited an average ECD of 1.1 μm and an average thickness of 0.35 μm. The tabular grains were estimated to account for greater than 70 percent of total grain projected area. There was no evidence of grain renucleation or of non-uniform epitaxial depositions.

Emulsion E (an emulsion according to the invention)

This emulsion was formed by depositing silver iodophosphate along with silver chloride onto a high chloride {100} tabular grain emulsion host containing 67 percent of total silver. The final emulsion contained 78 mole percent chloride, 16 mole percent phosphate and 6 mole percent iodide, based on total silver.

This emulsion was precipitated identically to Emulsion D, except that the 0.45M phosphate and 0.15M potassium iodide was replaced with a 0.45M trisodium phosphate dodecahydrate and 0.375M potassium iodide solution.

The grains were similar to those of Emulsion D, with an average ECD of 1.1 μm and an average grain thickness of 0.39 μm.

Photographic Coatings

Emulsions A, B and C were coated on a transparent film support having an antihalation backing layer at an emulsion coating coverage of 0.85 g/m$^2$ silver, 1.08 g/m$^2$ of a cyan dye-forming coupler and 2.7 g/m$^2$ of gelatin. The emulsion layer was overcoated with 1.6 g/m$^2$ of gelatin, and both layers were hardened with bis(vinylsulfonylmethyl)ether at 1.75 percent by weight, based on gelatin.

Spectrophotometry

After removal of the antihalation backing layer, the total transmittance and reflectance of the coatings were measured over the wavelength range of from 350 to 700 nm using a standard integrating sphere spectrophotometer.

Results

The percentage of light absorbed by the photographic elements containing Emulsions A, B and C over the spectrum of examination is shown in FIG. 1, wherein curves A, B and C represent the corresponding emulsion. Both Emulsions B and C show large increases in light absorption in the short blue region of the spectrum extending up to about 430 nm relative to the nearly pure chloride silver iodochloride host tabular grain Emulsion A. In the spectral region of from about 430 nm to 470 nm Emulsion C, satisfying the requirements of the invention, also exhibits a large absorption increase as compared to Emulsion B, which contains the same concentration of iodide.

Figure 2:
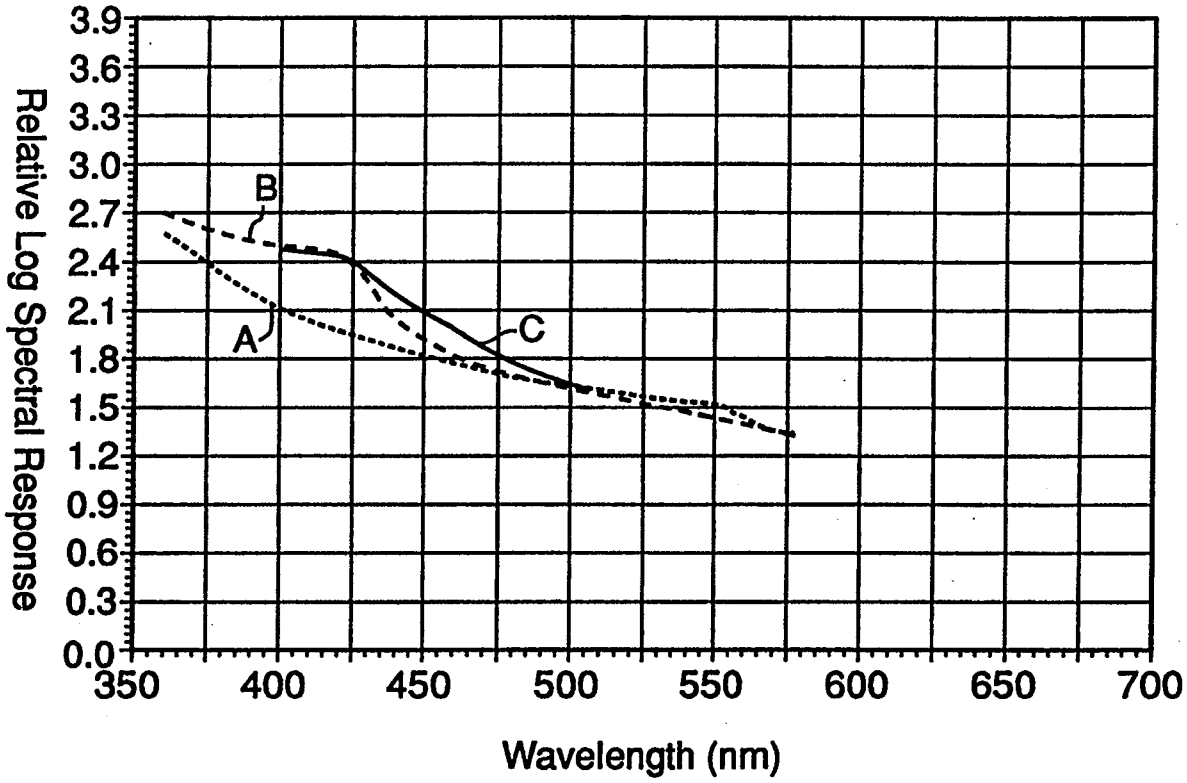
FIG. 2 is plot of projected speeds, based on absorption, over the spectral range of from 350 to 700 nm.

The advantage in long blue light absorption of Emulsion C relative to Emulsions A and B can be projected as a speed advantage, as illustrated in FIG. 2. At 450 nm Emulsion B by reason of its increased iodide content can be expected to provide approximately a half stop (0.15 log E, where E represents exposure in lux-seconds) speed advantage over comparative Emulsion A lacking iodide inclusion. Emulsion C, which contains the same iodide concentration as Emulsion B and additionally contains silver phosphate, can be expected to provide a full stop (0.3 log E) speed advantage over Emulsion A at 450 nm and a half stop (0.15 log E) speed advantage over Emulsion B.

The invention has been described in detail with particular reference to preferred embodiments thereof, but it will be understood that variations and modifications can be effected within the spirit and scope of the invention.

What is claimed is:

1. A radiation sensitive emulsion containing a silver halide grain population, at least 50 percent of the grain population projected area being accounted for by tabular grains each having an aspect ratio of at least 2, wherein the tabular grains are each comprised of (1) a tabular substrate containing at least 50 mole percent chloride, based on silver, bounded by {100} major faces and (2) a portion deposited uniformly on the major faces of the substrate containing a silver salt exhibiting a higher solubility than silver iodide and a higher absorption of blue light at wavelengths longer than 450 nm than silver iodide.

2. A radiation sensitive emulsion according to claim 1 wherein the deposited portion additionally contains up to 10 mole percent iodide.

3. A radiation sensitive emulsion according to claim 2 wherein the deposited portion contains less than 3 mole percent iodide.

4. A radiation sensitive emulsion according to claim 1 wherein the tabular substrate contains from 5 to 95 percent of the total silver forming the grain.

5. A radiation sensitive emulsion according to claim 4 wherein the tabular substrate contains at least 50 percent of the total silver forming the grain.

6. A radiation sensitive emulsion according to claim 1 wherein the silver salt is comprised of silver phosphate.

7. A radiation sensitive emulsion according to claim 6 wherein the deposited portion contains at least 0.1 mole percent iodide.

8. A radiation sensitive emulsion according to claim 7 wherein the deposited portion contains at least 0.5 mole percent iodide.

9. A radiation sensitive emulsion according to claim 8 wherein silver phosphate is present in the deposited portion in a concentration ranging from 1 to 50 mole percent, based on silver.

10. A radiation sensitive emulsion according to claim 9 wherein silver phosphate is present in the deposited portion in a concentration of less than 30 mole percent, based on silver.

11. A radiation sensitive emulsion according to claim 1 wherein the deposited portion consists essentially of from 5 to 20 mole percent silver phosphate, from 0.5 to less than 3 mole percent silver iodide, up to 10 mole percent silver bromide and silver chloride forming the balance of the deposited portion.

12. A radiation sensitive emulsion containing a silver halide grain population, at least 50 percent of the grain population projected area being accounted for by tabular grains each having an aspect ratio of at least 2, wherein the tabular grains are each comprised of (1) a tabular substrate containing at least 50 mole percent chloride, based on silver, bounded by {100} major faces and (2) a portion deposited on the substrate comprised of silver phosphate and containing at least 0.1 mole percent iodide, thereby exhibiting a higher solubility than silver iodide and a higher absorption of blue light at wavelengths longer than 450 nm than silver iodide.

13. A radiation sensitive emulsion according to claim 12 wherein the deposited portion contains up to 10 mole percent iodide.

14. A radiation sensitive emulsion according to claim 13 wherein the deposited portion contains less than 3 mole percent iodide.

15. A radiation sensitive emulsion according to claim 12 wherein the tabular substrate contains from 5 to 95 percent of the total silver forming the grain.

16. A radiation sensitive emulsion according to claim 15 wherein the tabular substrate contains at least 50 percent of the total silver forming the grain.

17. A radiation sensitive emulsion according to claim 12 wherein the deposited portion contains at least 0.5 mole percent iodide.

18. A radiation sensitive emulsion according to claim 17 wherein silver phosphate is present in the deposited portion in a concentration ranging from 1 to 50 mole percent, based on silver.

19. A radiation sensitive emulsion according to claim 12 wherein silver phosphate is present in the deposited portion in a concentration of less than 30 mole percent, based on silver.

20. A radiation sensitive emulsion according to claim 12 wherein the deposited portion consists essentially of from 5 to 20 mole percent silver phosphate, from 0.5 to less than 3 mole percent silver iodide, up to 10 mole percent silver bromide and silver chloride forming the balance of the deposited portion.

* * * * *